US005667400A

United States Patent [19]

Janczak et al.

[11] Patent Number: 5,667,400

[45] Date of Patent: Sep. 16, 1997

[54] OBLIQUELY DISPOSED INSULATION DISPLACEMENT CONTACT

[75] Inventors: Andreas Janczak; Dieter Gerke, both of Berlin, Germany

[73] Assignee: Krone Aktiengesellschaft, Berlin-Zehlendorf, Germany

[21] Appl. No.: 398,114

[22] Filed: Mar. 3, 1995

[30] Foreign Application Priority Data

Mar. 29, 1994 [DE] Germany ..... 44 11 482.6

[51] Int. Cl.[6] ..... H01R 4/24

[52] U.S. Cl. ..... 439/395; 439/389

[58] Field of Search ..... 439/395–405, 439/417–419

[56] References Cited

U.S. PATENT DOCUMENTS 4,533,193 8/1985 Blackwood ..... 439/404

4,611,874 9/1986 Gerke et al. ..... 439/404

5,131,863 7/1992 Gerke et al. ..... 439/395

*Primary Examiner*—David L. Pirlot

*Attorney, Agent, or Firm*—McGlew and Tuttle

[57] ABSTRACT

An obliquely disposed insulation displacement contact for the communication and data transfer. Wires having a lower rigidity than a copper wire of 0.4 mm diameter can also be contacted, and the insulation displacement contact to be provided is intended to fit into the previously used receiving portions of housings, without reducing the rigidity of the insulation displacement contact. This is achieved by opposingly providing angles, bending or parallely displacing contact parts towards outside the contact zones of the contact legs in the area of the contact slot or by cut-free portions of the contact zones.

15 Claims, 5 Drawing Sheets

OBLIQUELY DISPOSED INSULATION DISPLACEMENT CONTACT

FIELD OF THE INVENTION

The present invention relates to an obliquely disposed insulation displacement contact, in particular for communication and data transfer, the insulation displacement contact including a metal blade spring material with two contact legs separated to define a contact slot and rigidly connected to each other at one end thereof.

BACKGROUND OF THE INVENTION

From DE 28 14 069, there is known in the art an obliquely disposed insulation displacement contact, wherein the wire to be contacted is introduced into the contact slot of the insulation displacement contact at an angle smaller than 90° (preferably between 30° and 60°). By this obliquity of the contact slot relative to the axis of the wire, the latter is notched at two opposed positions when pressing it in. Thereby firm contact with sufficient contact pressure is achieved.

The prior art obliquely disposed insulation displacement contacts cannot be employed for wires having diameters smaller than 0.4 mm, since the two contact forces diagonally opposed at the contact notches cause a resulting bending moment deforming the wire to be contacted. With a not sufficient rigidity of the wire, heavy wire deformations may be caused. The limit of rigidity for a copper wire is at a diameter of approx. 0.4 mm. Another disadvantage of the prior art obliquely disposed insulation displacement contacts is the rigidity of the contact itself. In order that a safe contact between the insulation displacement contact and the wire is established, a sufficient rigidity of the insulation displacement contact has to be ensured, since otherwise the insulation displacement contact will be deformed when the wire is introduced and no sufficient contact force will result. Thus, the selection of materials for the insulation displacement contact is limited by the given contact geometry.

From DE 41 26 068, there is known in the art an obliquely disposed insulation displacement contact wherein the contact legs are each displaced by approximately one half of the material thickness of the blade spring material towards the front and rear sides thereof, the contact edges of the contact legs limiting the contact slot being arranged in parallel to each other over their full length. Thereby, a uniform width of the contact slot over its full length is achieved, the width of the contact slot being in the range of 0 to 0.05 mm. This permits contact to very thin wires and strands as electrical conductors. Further, higher rigidity of the insulation displacement contact is obtained, without high forces acting on the housing receiving the insulation displacement contact. It is disadvantageous, with these obliquely disposed insulation displacement contacts, that by the torsioning and shearing of the contact legs the area of the contact legs to be received in the housing is also widened. This problem could be eliminated by a narrower dimensioning of the insulation displacement contact, but making the insulation displacement contact narrower will result in a reduction of the rigidity of the insulation displacement contact.

SUMMARY AND OBJECTS OF THE INVENTION

It is therefore the object of the invention to provide an obliquely disposed insulation displacement contact of the type referred to hereinbefore, by means of which wires having a lower rigidity than a copper wire of 0.4 mm diameter can also be contacted, and wherein the insulation displacement contact to be provided is intended to fit into the previously used receiving portions of the housing, without reducing the rigidity of the insulation displacement contact.

According to the invention, an obliquely disposed insulation displacement contact is provided, particularly for use in communication and data transfer. The insulation displacement contact includes a metal blade spring material with two contact legs separated to define a contact slot. The two contact legs are rigidly connected to each other at a lower end of the contact slot. Each leg has a contact zone. The contact zones of the contact legs in the area of the contact slot include angle portions, angled outwardly in opposite directions relative to a plane of the contact legs.

By opposingly providing angled portions, bent or displaced in parallel towards the outside or opposingly cutting the contact zones of the contact legs free in the area of the contact slot, the distance between the two contact positions of the contact zones will be reduced. Thereby, the distance of the force components of the contact forces acting at right angles on the wire will also be reduced. These two anti-parallel force components will effect a resulting bending moment. The amount of the force components remains identical, the point of application is however changed. This is equivalent to a reduction of the lever arm, and the bending moment will also be reduced. Therefore, thin wires and strands can now also be contacted. Heretofore a too high bending moment would lead to wire breakage. For contacting strands, in particular the embodiments are suitable, where the contact zones of the contact legs are outwardly bent off, since the thus formed contact faces are rounded off. Since the geometrical dimensions of the contact legs are not changed in the areas, where these are received in the housing, the insulation displacement contact according to the invention can be placed therein without design modifications. By providing angles, bending or displacing in parallel the contact zones, in addition to the aforementioned advantages the rigidity of the insulation displacement contact will be increased, whereas the rigidity will only slightly be modified for the embodiment having the cut-free portions. By the increase of the rigidity of the insulation displacement contact, less expensive materials can be used, without the contact quality being affected.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 1 shows a section of a prior art housing 1 regularly receiving several insulation displacement contacts 2, only one insulation displacement contact 2 being shown here for the sake of simplicity. The contact 2 consists of a metal blade spring material with two contact legs 4 separated along the contact slot 3 and connected to each other at their one end. In order to achieve an oblique position of the insulation displacement contact 2, slot-type receiving portions 5 are provided obliquely at offset, opposed positions in the housing 1 preferably made of plastic. Depending on how far the receiving portions 5 are offset from each other, the introduction angle of the wire to be contacted relative to the contact legs 4 of the insulation displacement contact 2 will be changed. When the contact legs 4 have different axis positions, as is described in the DE 41 26 068, the effective width of the contact legs 4 will be increased, as is shown in broken lines in FIG. 1. The width B of the receiving portion 5 therefore would have to be increased, for the prior art obliquely disposed insulation displacement contact 2 with offset-axis or rotated contact legs 4, since thereby the resulting width of the insulation displacement contact 2 is increased in the area of the receiving portion 5 to such an extent that the contact legs 4 no longer in the receiving portions 5.

Figure 1:
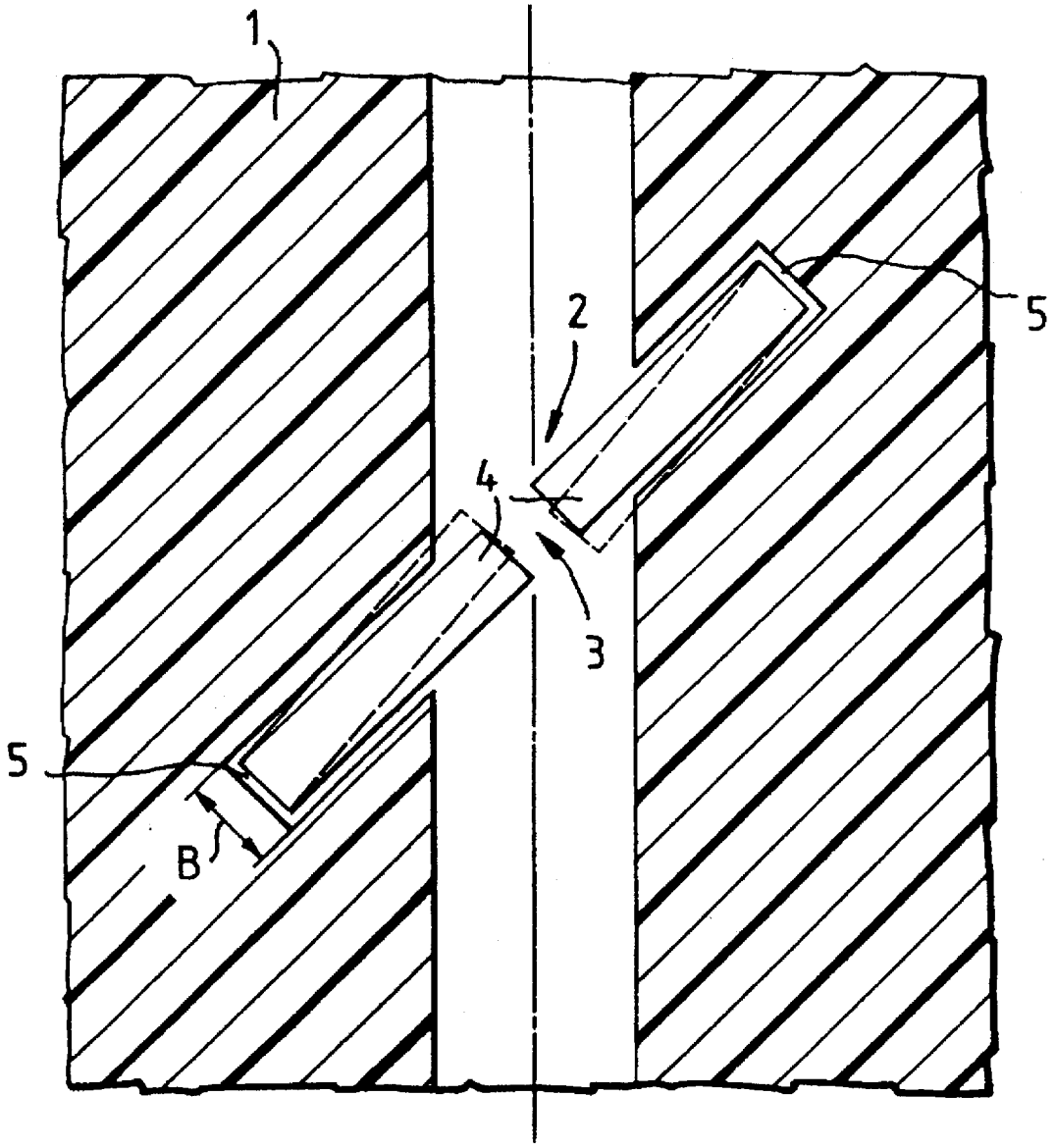
FIG. 1 is a sectional view of a housing having a prior art obliquely disposed insulation displacement contact.
Figure 2:
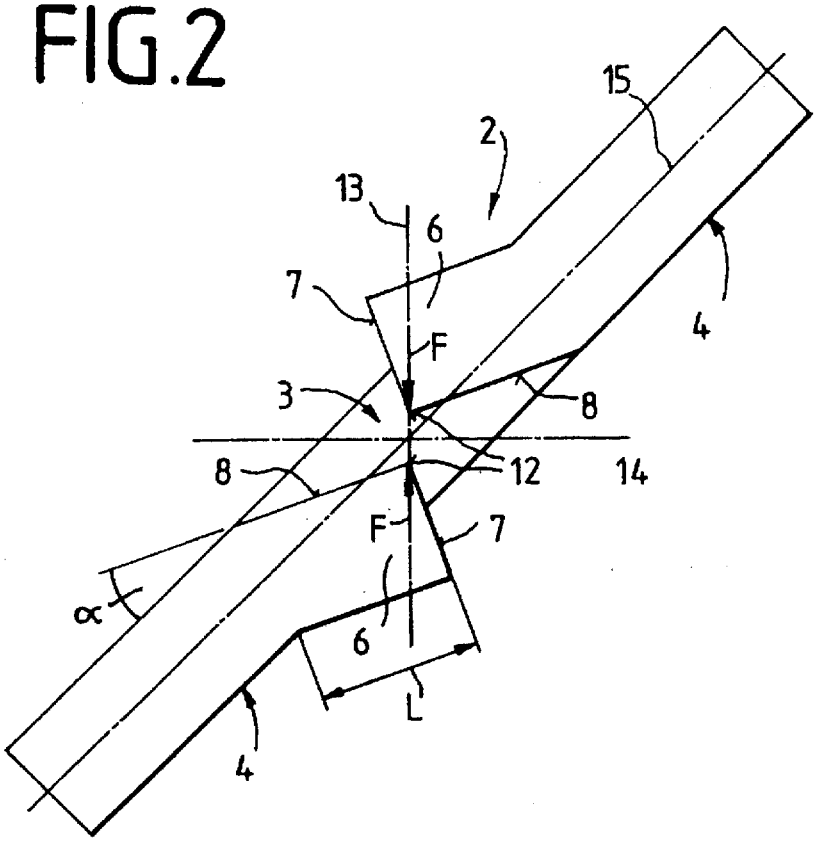
FIG. 2 is a top view of the contact legs having contact zones being at outwardly directed angles and having a resulting bending moment of zero.

The embodiment according to the invention of an obliquely disposed insulation displacement contact 2 is shown in FIG. 2. The contact legs 4 are positioned in a common plane, so that they would be in one piece if extended over the contact slot 3. The contact zones 6 of the contact legs 4 limiting the contact slot 3 are disposed at angles outwardly bent off in opposed directions, their front sides 7 or outer sides 8, resp. being in parallel. The upper sides of the contact legs 4 are positioned in a common plane, i.e. the contact legs have identical heights. Depending on at what angle α or over what length L the angle of the contact zones 6 is provided, the contact point 12 formed by the contact edges between the front side 7 and the outside 8 directed towards the wire will be displaced. In the embodiment according to FIG. 2, the two contact points 12, and thus the components of the contact force F, disposed at right angles to the axis 14 of the introduced wire are, on a common line of action 13 which is vertical to the axis 14 of the introduced wire. The resulting bending moment caused by the two contact forces F is consequently zero. In the area of the receiving portions 5, the geometrical structure of the insulation displacement contact 2 remains unchanged compared to the prior art insulation displacement contacts 2 used for the housings 1, so that the insulation displacement contacts 2 can be introduced without any problem into the receiving portions 5 of the housing 1 of FIG. 1.

Figure 3:
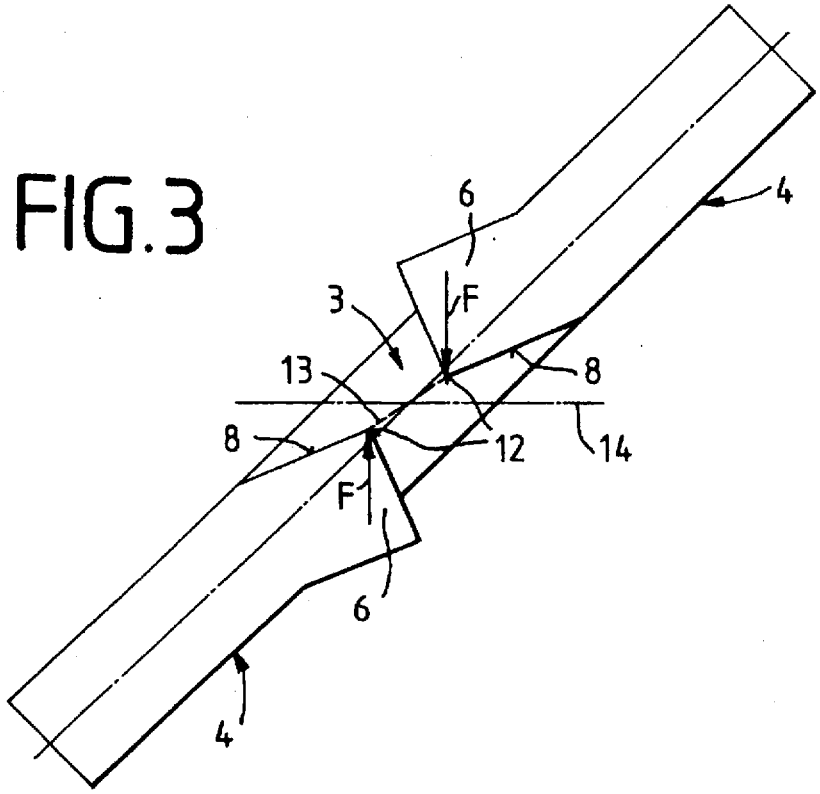
FIG. 3 is a top view according to FIG. 2 with a resulting bending moment different from zero.

In the embodiment of FIG. 3, the angle α at which the contact zones 6 are bent is smaller than in the embodiment according to FIG. 2. Therefore the two contact points 12 are on a line of action 13 which oblique relative to the axis 14 of the introduced wire. Thus, the two components F of the contact forces vertically acting on the axis 14 of the introduced wire are not on a common line of action, so that a resulting bending moment different from zero, but smaller than that achieved without any angled portions. Depending on the type of the wires to be contacted, the angle α at which the bending is intended to be made can be varied, and thus the resulting bending moment can be adjusted.

Figure 4:
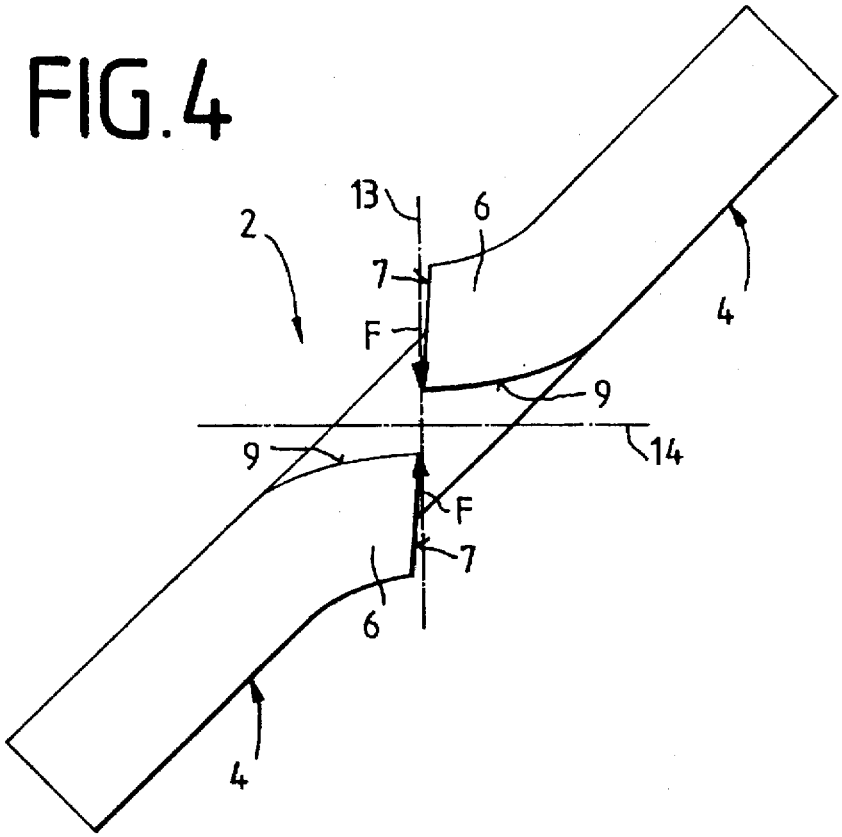
FIG. 4 is a top view of the contact legs having contact zones which are outwardly bent off and which have a resulting bending moment of zero.

In FIG. 4 is shown an embodiment of the obliquely disposed insulation displacement contact 2 for contacting wire strands. Instead of a sharp angle as in the preceding embodiment, here the contact zones 6 of the contact legs 4 are outwardly opposedly bent off at a certain bending radius. For contacting strands, it is advantageous if the contact is established over a rounded-off outside 9, in order not to damage the wire strands. The thus formed rounded-off outside 9 prevents a cut in the strands. In this embodiment, the bending radius and bending length are selected such that a resulting bending moment of zero occurs, for the contact points 12 of the contact zones 6 are then on the line of action 13 which is at a fight angle to the axis 14 of the wire.

Figure 5:
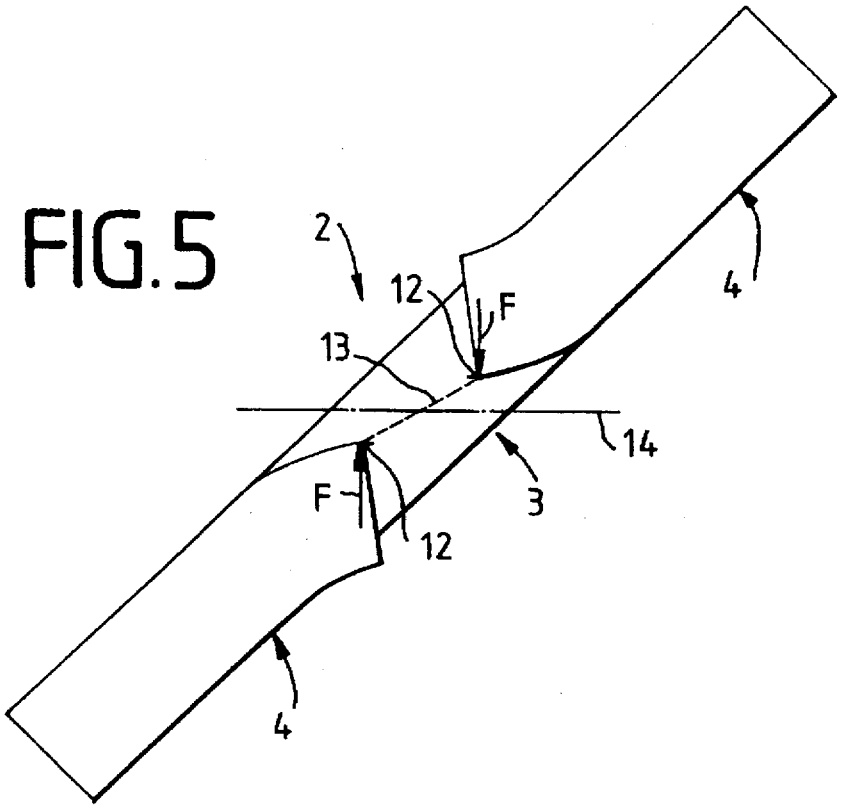
FIG. 5 is a top view according to FIG. 4 with a resulting bending moment different from zero.

In the embodiment of FIG. 5, a larger bending radius has been selected, so that with identical bending length the two contact points 12 of the contact zones 6 are on a line of action 13 not being vertical to the axis 14 of the introduced wire, what causes a bending moment. By varying bending radius and bending length, the resulting lever arms of the contact forces can be displaced relative to each other.

Figure 6:
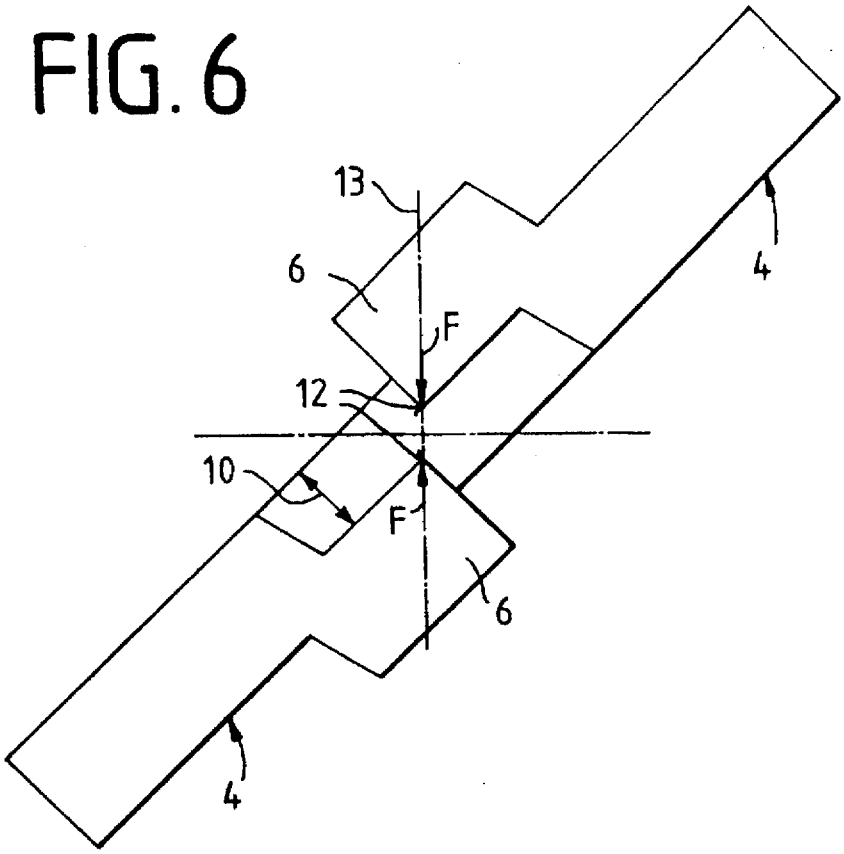
FIG. 6 is a top view of the contact legs having contact zones which are outwardly displaced n parallel and having a resulting bending moments of zero.

In FIG. 6 is shown an embodiment, wherein the contact zones 6 of the contact legs 4 relative to the plane of the contact legs 4 are displaced in parallel towards the outside in opposite directions by the depth 10. However, the contact zones 6 is directed in parallel to the original plane of the contact legs 4. The parallel displacement is performed in opposite directions, i.e. one contact zone 6 is on one side and the other contact zone 6 on the other side of the plane of the contact legs 4. In this embodiment, the common line of action 13 of the contact points 12 of the contact zones 6 including the contact slot 3 is again at a fight angle to the axis of the introduced wire, so that a resulting bending moment of zero occurs. By changing the depth 10 of the parallel displacement from the plane of the contact legs 4, the resulting lever arms can be displaced relative to each other.

Figure 7:
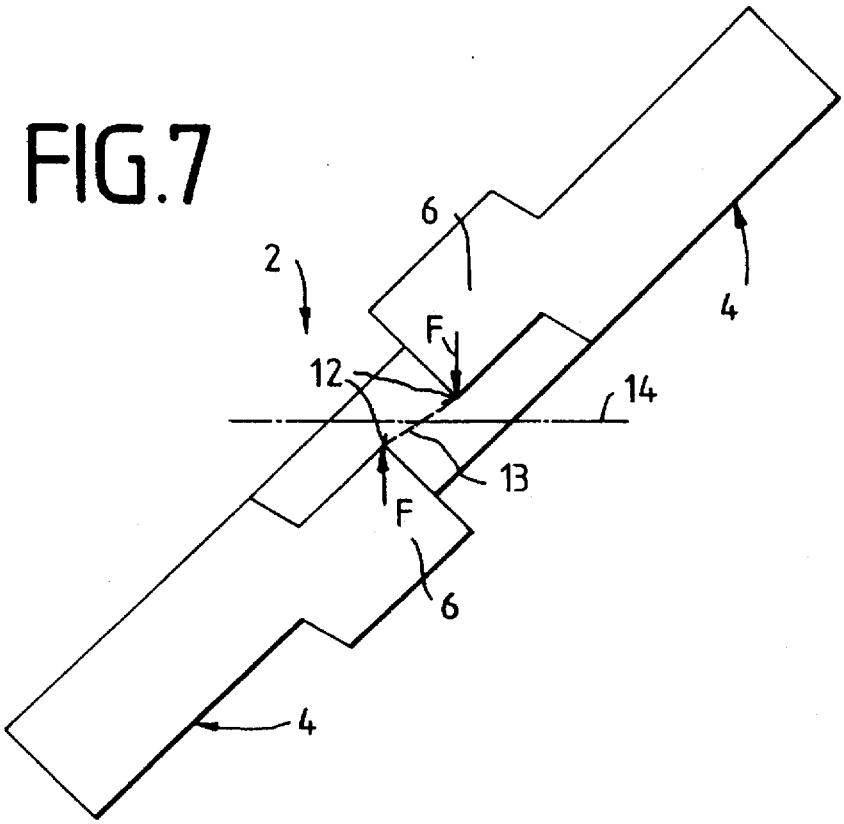
FIG. 7 is a top view according to FIG. 6 with a resulting bending moment different from zero.

In FIG. 7 is shown a similar embodiment as in FIG. 6, wherein the depth 10 is selected such that a resulting bending moment is maintained, since the line of action 13 of the contact points 12 is disposed obliquely to the axis 14 of the introduced wire.

Instead of by providing angles or by bending, a displacement of the lever arms can also be performed by cut-free portions 11.

Figure 8:
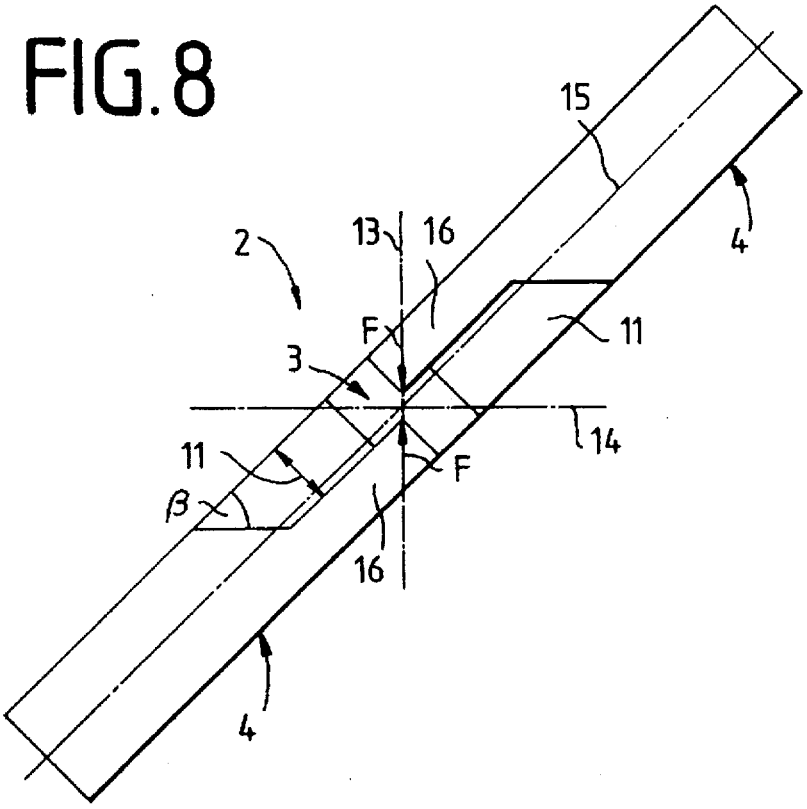
FIG. 8 is a top view of the contact legs having cut-free portions at the contact zones and having a resulting bending moment of zero.

In FIG. 8 is shown an embodiment with trapezoidal cut-free portions 11. The cut-free portions 11 are at the sides of the contact legs 4 being directed towards the axis 14 of the wire. Thereby contact zones 16 are formed, the width of which is smaller than the material thickness of the contact legs 4, in contrast to the embodiments according to FIGS. 2 to 7, wherein the width of the contact zones 6 is identical to the material thickness of the contact legs 4. The two contact points 12 are displaced towards the central axis 15 of the contact legs 4. The trapezoid angle β and the length L of the cut-free portion 11 are selected in this embodiment such that the line of action 13 of the contact points 12 is at a right angle to the axis 14 of the wire to be introduced, so that there is no resulting bending moment.

Figure 9:
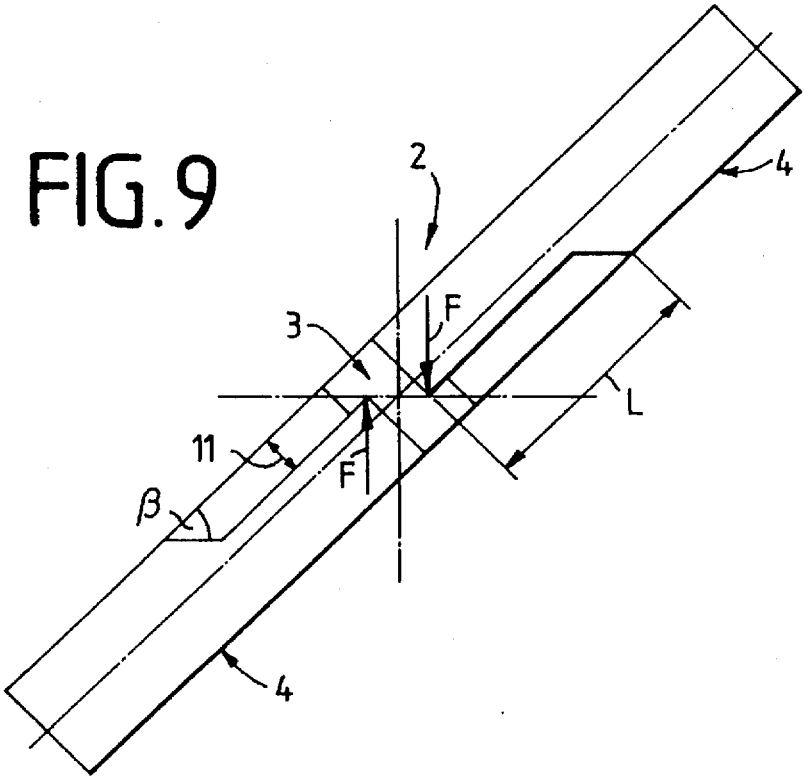
FIG. 9 is a top view according to FIG. 8 with a resulting bending moment different from zero.

In the embodiment of FIG. 9, a small trapezoid angle β and the length L of the cut-free portion 11 are selected such that a resulting bending moment because of the force components is maintained. Since the reduction of the width of the contact legs 4 is performed only in the area of the contact zones 16 of the contact slot 3, the modifications of the rigidity of the insulation displacement contact 2 are of minor significance.

Instead of by cut-free portions, the contact geometry of the contact legs 4 of FIGS. 8 and 9 can also be obtained by plastic deformation, e.g. by pressing.

While specific embodiments of the invention have been shown and described in detail to illustrate the application of the principles of the invention, it will be understood that the invention may be embodied otherwise without departing from such principles.

What is claimed is:

1. An insulation displacement contact disposed obliquely with respect to a direction of extension of a wire disposed in a contact position, for communication and data transfer, the insulation displacement contact comprising:

metal blade spring material including a base portion, a first contact leg connected to said base portion and a second contact leg connected to said base portion, said first contact leg and said second contact leg extending along a contact leg center line and being separated to define a contact slot, said first contact leg having a first leg angled portion and said second contact leg having a second leg angled portion, said first leg angled portion and said second leg angled portion being angled outwardly away from said centerline with said first leg angled portion angled in one direction and said second leg angled portion angled in a direction opposite to said one direction, said first contact leg angled portion having a wire adjacent first contact leg outside face and having a first contact leg front face, said wire adjacent first contact leg outside face and said first contact leg front face cooperating to form a first linear contact edge defining a first contact zone on one side of said contact slot, said second contact leg angled portion having a wire adjacent second contact leg outside face and having a second contact leg front face, said wire adjacent second contact leg outside face and said second contact leg front face cooperating to form a second linear contact edge defining a second contact zone on another side of said contact slot.

2. An insulation displacement contact according to claim 1, wherein said angled portions are portions bent off from said contact legs, in outwardly opposed directions.

3. An insulation displacement contact according to claim 1, wherein said wire adjacent first contact leg outside face is at an angel of substantially 90° with respect to said first contact leg front face and said wire adjacent second contact leg outside face is at an angel of substantially 90° with respect to said second contact leg front face.

4. An insulation displacement contact according to claim 1, wherein said first contact zone points toward said direction of extension laterally outwardly of said center line and said second contact zone points toward said direction of extension laterally outwardly of said center line.

5. An insulation displacement contact according to claim 1, wherein said first contact zone points toward an intersection of said center line and said direction of extension and said second contact zone points toward an intersection of said center line and said direction of extension.

6. An insulation displacement contact according to claim 1, wherein said insulation displacement contact is disposed substantially at 45° with respect to said direction of extension of a wire disposed in a contact position.

7. An insulation displacement contact disposed obliquely with respect to a direction of extension of a wire disposed in a contact position, for communication and data transfer, the insulation displacement contact comprising:

a metal blade spring material defining a contact base with two contact legs being rigidly connected to said base and extending from said base, said two contact legs extending along a contact leg center line and being separated to define a contact slot, a first contact leg having a first leg angled portion and a second contact leg having a second leg angled portion, said first leg angled portion and said second leg angled portion being angled outwardly away from said centerline with said first leg angled portion angled in one direction and said second leg angled portion angled in a direction opposite to said one direction, said first contact leg angled portion having a wire adjacent first contact leg outside face and having a first contact leg front face, said wire adjacent first contact leg outside face and said first contact leg front face cooperating to form a first linear contact edge defining a first contact zone on one side of said contact slot, said second contact leg angled portion having a wire adjacent second contact leg outside face and having a second contact leg front face, said wire adjacent second contact leg outside face and said second contact leg front face cooperating to form a second contact edge defining a second linear contact zone on another side of said contact slot, said first contact zone associated with one of said legs being displaced outwardly in one direction and said second contact zone, associated with the other contact leg, being displaced outwardly in an opposite direction, said first contact zone being parallel to said second contact zone.

8. An insulation displacement contact according to claim 7, wherein a depth of displacement of said parallel contact zones corresponds to one half of a thickness of said contact legs.

9. An insulation displacement contact according to claim 7, wherein said insulation displacement contact is disposed substantially at 45° with respect to said direction of extension of a wire disposed in a contact position.

10. An insulation displacement contact disposed obliquely with respect to a wire 10 be contacted, comprising:

a metal blade spring material defining a base with two contact legs rigidly connected thereto, said two contact legs extending along a contact leg center line and being separated to define a contact slot, a first of said contact legs having a first leg cut free portion with a first leg cut free portion center line radially outwardly of said center line and a second of said contact legs having a second leg cut fee portion with a second leg cut free portion center line radially outwardly away from said center line, said second leg cut free portion being at a diagonally opposed portion from said first leg cut free portion, said first leg cut free portion having a wire adjacent first contact leg outside face and having a first contact leg front face, said wire adjacent first contact leg outside face and said first contact leg front face cooperating to form a first linear contact edge defining a first contact zone on one side of said contact slot, said second leg cut free portion having a wire adjacent second contact leg outside face and having a second contact leg front face, said wire adjacent second contact leg outside face and said second contact leg front face cooperating to form a second linear contact edge defining a second contact zone on another side of said contact slot, said contact zones being disposed in an area of said contact slot, said first leg contact zone having a cut free portion at a diagonally opposed position from a cut free portion of said second leg contact zone.

11. An insulation displacement contact according to claim 10, wherein a depth of a cut free portion of said first and second contact zones corresponds approximately to one half of a thickness of said contact legs.

12. An insulation displacement contact according to claim 10, wherein said wire adjacent first contact leg outside face is at an angel of substantially 90° with respect to said first contact leg front face and said wire adjacent second contact leg outside face is at an angel of substantially 90° with respect to said second contact leg front face.

13. An insulation displacement contact according to claim 10, wherein said first contact zone points toward said direction of extension laterally outwardly of said center line and said second contact zone points toward said direction of extension laterally outwardly of said center line.

14. An insulation displacement contact according to claim 10, wherein said first contact zone points toward an intersection of said center line and said direction of extension, and said second contact zone points toward an intersection of said center line and said direction of extension.

15. An insulation displacement contact according to claim 10, wherein said insulation displacement contact is disposed substantially at 45° with respect to said direction of extension of a wire disposed in a contact position.

* * * * *